US007055709B1

(12) United States Patent
Esau

(10) Patent No.: US 7,055,709 B1
(45) Date of Patent: Jun. 6, 2006

(54) RECEPTACLE CAP FOR PILLS AND OTHER ARTICLES

(76) Inventor: Theodore Esau, 8254 Kingslee Rd., Bloomington, MN (US) 55438

( * ) Notice: Subject to any disclaimer, the term of this patent is extended or adjusted under 35 U.S.C. 154(b) by 45 days.

(21) Appl. No.: 10/813,737

(22) Filed: Mar. 30, 2004

Related U.S. Application Data

(60) Provisional application No. 60/459,590, filed on Mar. 31, 2003.

(51) Int. Cl.
*B65D 39/00* (2006.01)

(52) U.S. Cl. ..... 215/228; 220/521

(58) Field of Classification Search ..... 215/228, 215/227; 220/521, 522, 4.26
See application file for complete search history.

(56) References Cited

U.S. PATENT DOCUMENTS

| | | | | |
|---|---|---|---|---|
| 47,238 | A | | 4/1865 | Whitall |
| 197,595 | A | | 11/1877 | Brown |
| 769,615 | A | | 9/1904 | Kosansvich |
| 1,029,017 | A | | 6/1912 | Jones |
| 1,033,009 | A | | 7/1912 | Hall |
| 1,668,979 | A | | 5/1928 | Ruttan |
| 1,750,334 | A | | 3/1930 | Stern |
| 1,858,134 | A | | 5/1932 | Booth et al. |
| 2,048,219 | A | | 7/1936 | Putter |
| 2,072,630 | A | | 3/1937 | Ferry |
| 2,305,002 | A | | 12/1942 | Harris |
| 2,320,070 | A | | 5/1943 | Derham et al. |
| 2,629,508 | A | | 2/1953 | Prager |
| 2,738,890 | A | | 3/1956 | Dahl et al. |
| 2,766,796 | A | | 10/1956 | Tupper |
| 2,836,323 | A | | 5/1958 | Robinson |
| 3,326,400 | A | | 6/1967 | Hamelin et al. |
| 3,367,484 | A | | 2/1968 | Nelson |
| 3,433,378 | A | | 3/1969 | Ross |
| 3,446,179 | A | | 5/1969 | Bender |
| D214,719 | S | | 7/1969 | Terre |
| 3,613,955 | A | | 10/1971 | Wetherell |
| 3,768,688 | A | | 10/1973 | Linke |
| D244,256 | S | | 5/1977 | Dekker |
| 4,195,730 | A | | 4/1980 | Hunt |
| 5,056,681 | A | | 10/1991 | Howes |
| 5,238,140 | A | | 8/1993 | Maze |
| 5,318,183 | A | | 6/1994 | Cohen et al. |
| 5,397,017 | A | | 3/1995 | Muza et al. |
| D359,907 | S | | 7/1995 | Hirsch |
| 5,465,835 | A | * | 11/1995 | Schumacher et al. ..... 206/221 |
| 5,524,788 | A | | 6/1996 | Plester |
| 5,836,479 | A | | 11/1998 | Klima et al. |

(Continued)

*Primary Examiner*—Lien M. Ngo
(74) *Attorney, Agent, or Firm*—Albert W Watkins

(57) ABSTRACT

An infinitely stacking receptacle cap cooperates with existing bottles and bottle caps for holding pills and other articles separate from liquid within the bottle. In one embodiment, the bottle has a liquid impervious body and a neck with external threads. The infinitely stacking receptacle cap has a divider wall, and an internally threaded cavity adjacent to and extending from the divider wall in a first direction encompassing and engaging with the bottle neck threads. The internally threaded cavity has a height corresponding to the bottle neck height. An externally threaded infinitely stacking receptacle cap neck is adjacent to and extends from the divider wall in a direction generally opposed to the internally threaded cavity. The height of the externally threaded stacking receptacle cap neck is equal to the bottle neck height. The bottle cap has an internally threaded cavity encompassing and engaging with the external threads of the sectional container neck and has a height corresponding to the bottle neck height.

18 Claims, 2 Drawing Sheets

U.S. PATENT DOCUMENTS

| | | | |
|---|---|---|---|
| 5,848,731 | A | 12/1998 | Deering |
| 6,062,441 | A | 5/2000 | Mengeu et al. |
| D426,466 | S | 6/2000 | Nevins et al. |
| 6,085,919 | A | 7/2000 | Singer |
| 6,263,923 | B1 | 7/2001 | Castillo |
| 6,302,295 | B1 | 10/2001 | Weisman |
| 6,386,358 | B1 | 5/2002 | North et al. |
| 6,419,081 | B1 | 7/2002 | Ross |
| 6,478,155 | B1 | 11/2002 | Bunyan |
| 2002/0008116 | A1 | 1/2002 | Sorenson et al. |
| 2002/0011277 | A1 | 1/2002 | Castillo |
| 2002/0130126 | A1* | 9/2002 | Rosenberg ..... 220/4.26 |
| 2002/0166835 | A1 | 11/2002 | Carter |
| 2003/0000910 | A1 | 1/2003 | Jang et al. |

* cited by examiner

RECEPTACLE CAP FOR PILLS AND OTHER ARTICLES

CROSS REFERENCE TO RELATED APPLICATIONS

This application claims priority to U.S. provisional patent application Ser. No. 60/459,590 filed Mar. 31, 2003 having the same title and inventor, the contents which are incorporated herein by reference in entirety.

BACKGROUND OF THE INVENTION

1. Field of the Invention

This invention pertains generally to special receptacles or packages for ampules, capsules, pellets, granules, and other solids or liquids. More particularly, the present invention pertains to stacking bottle closures having structure for removably holding an article, material or liquid therein.

2. Description of the Related Art

As the knowledge of mankind has grown, so has the recognition of many beneficial substances and compounds. The substances and compounds have been studied extensively, and are often extracted, refined, concentrated or otherwise processed to provide the most desired combination of benefits and features, while enabling a person to ingest these without having to substantially alter their diet or lifestyle. Exemplary compounds are medications, nutritional supplements such as vitamins, herbal extracts and the like, and various other compounds too numerous to specifically mention herein, generally referred to herein below as medicaments. One specific compound of interest herein is aspirin, which has been shown to have particularly unusual benefit when consumed immediately before, during or immediately subsequent to a heart or circulatory event such as a heart attack or the like.

However beneficial such medicaments may be, when concentrated and tableted or otherwise preserved in dry, solid or semi-solid form, they are generally very difficult to ingest. Consequently, a person will most typically place the medicament in one's mouth, and then imbibe sufficient liquid to wash the medicament from the mouth into the stomach. Most commonly, a person will fill a cup with sufficient liquid, open the receptacle, bottle or the like in which the medicament is stored, remove the appropriate numbers of pills, tablets, or volume of medicament, place the medicament in their mouth, transfer the liquid from the cup into their mouth, and then swallow.

Unfortunately, the typical method of ingesting such compounds requires ready access to both liquid and pill bottle. There are many occasions where such access is not readily available or practical. Consequently, a person would prefer to be able to package small items such as pills or the like together with a liquid, and be able to transport the combined package wherever desired or required.

A number of artisans have recognized this need, and have provided available solutions. Exemplary are United States patents: U.S. Pat. No. 5,056,681 to Howes which illustrates a bottle or can insert that does not change the external appearance of the receptacle, but holds in a dry and isolated compartment an item for the user of the receptacle; U.S. Pat. No. 5,397,017 to Muza et al, which illustrates a water bottle cap with a multi-compartment pill dispenser; U.S. Pat. No. 6,386,358 to North et al, which illustrates a water bottle and cover, where the cover stores sealed tablets and, when the seal is broken, either the tablet falls into the water for consumption with the water or the tablet is freed for drinking as the water washes the pill into the user's mouth; and published application 2002/0,166,835 to Carter, which illustrates a general container cover with a flip-open compartment for medications, including aspirin. Other pill holders are illustrated, for example, in U.S. Pat. No. 2,766,796 to Tupper, which illustrates a separate container in the drink cover that holds aspirins; U.S. Pat. No. 3,446,179 to Bender, which illustrates a bottle cover that extends into the neck of the bottle with a compartment for medications; and U.S. Pat. No. 6,419,081 to Ross, which illustrates a single-end-access or double-end-access container holding pills and water, the single-end-access variant providing a sub-container in the cap.

While these and the remaining multitude of approaches may have met with some limited success, the demands of the market place have not yet been satisfied sufficiently to result in a mainstream adaptation of these techniques. Unfortunately then, many lives are needlessly lost which would otherwise be prevented. Furthermore, persons continually adversely affect their health by not taking medicaments at appropriate times, owing to a temporary lack of available fluid, or by failing to have the medicament at the same time as the fluid.

SUMMARY OF THE INVENTION

In a first manifestation, the invention is, in combination, a fluid receptacle, cover and special receptacle cap. The fluid receptacle has a coupling, and an opening from an exterior to an interior. The opening permits fluid to pass between the fluid receptacle interior and exterior. The cover has a coupling co-operative with the fluid receptacle coupling, and prevents fluid from passing between fluid receptacle interior and exterior when coupled to the fluid receptacle coupling in a closing coupled relation. The cover is further removable entirely from the fluid receptacle coupling, to open the fluid receptacle opening. The special receptacle cap removably holds a first composition adjacent the fluid receptacle and separates the fluid receptacle coupling from the cover coupling. The special receptacle cap has a divider wall, and a first coupling affixed to the divider wall and co-operative with the fluid receptacle coupling. The divider wall is cooperative with the fluid receptacle to prevent fluid from passing between fluid receptacle interior and exterior when the special receptacle cap first coupling is coupled to the fluid receptacle coupling in a closing coupled relation. The first coupling is further removable entirely from the fluid receptacle coupling to separate divider wall from fluid receptacle and thereby open the receptacle opening. A second coupling is affixed to the divider wall and engages with the cover coupling in a closing coupled relation to form an enclosed chamber isolated from the fluid receptacle and at least partially releasing to open the enclosed chamber.

In a second manifestation, the invention is a combination bottle, cap, and sectional container. The bottle has a liquid impervious body with a height and horizontal cross-sectional area, and a neck having a horizontal cross-sectional area less than the horizontal cross-sectional area of the liquid impervious body and having an opening from a first open end to a second body end and opening into the liquid impervious body adjacent the second body end. The neck further has external threads. The sectional container has a divider wall, and an internally threaded cavity adjacent to and extending from the divider wall in a first direction encompassing and engaging with the bottle neck external threads. The internally threaded cavity has a height corresponding to the bottle neck height. An externally threaded sectional container neck is adjacent to and extends from the divider wall in a direction generally opposed to the internally threaded cavity and is enclosed at a first end by the divider wall and open at a second end, and further has external threads. The height of the externally threaded sectional container neck is equal to the bottle neck height. The cap has an internally threaded cavity encompassing and engaging with the external threads of the sectional container neck and has a height corresponding to the bottle neck height.

OBJECTS OF THE INVENTION

Exemplary embodiments of the present invention solve inadequacies of the prior art by providing a stacking, compact, two chamber bottle adjunct cap. A first object of the present invention is to enable a person to package a solid, semi-solid or liquid with a standard bottle or flask, without risk of interference or interaction between the ordinary contents of the standard bottle and the packaged material or medicament. A second object of the invention is for the adjunct cap to work cooperatively with the bottle and original cap to generally preserve the volume of the bottle and utilize the original cap. Another object of the present invention is to fabricate such structure which may readily be produced in volume for a minimum of cost. A further object of the invention is to enable the adjunct cap to be stacked indefinitely upon like adjunct caps, to permit segregation of a plurality of items or medicaments. Yet another object of the present invention is to enable the foregoing objects while using ordinary water and soda-pop bottles.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
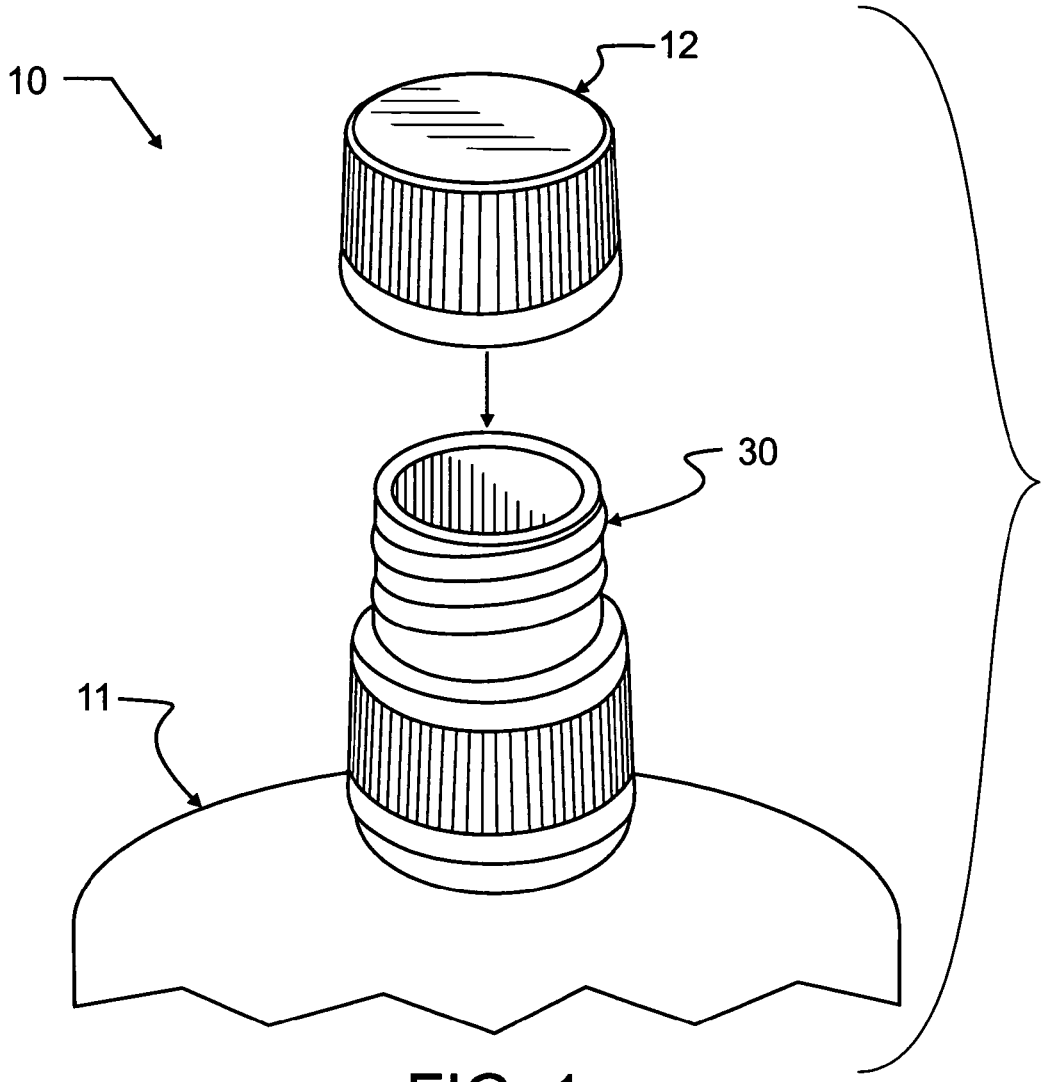
FIG. 1 illustrates a first preferred combination dispenser constructed in accord with the teachings of the invention from a partial projected and exploded plan view.
Figure 2:
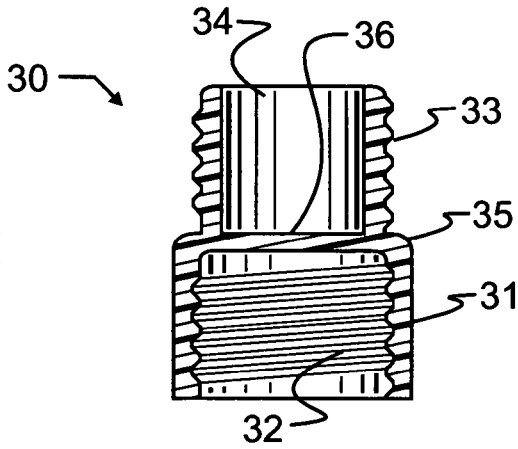
FIG. 2 illustrates the preferred embodiment adjunct cap used in the combination dispenser of FIG. 1 from a front sectional view that has been sectioned along a vertical plane.
Figure 3:
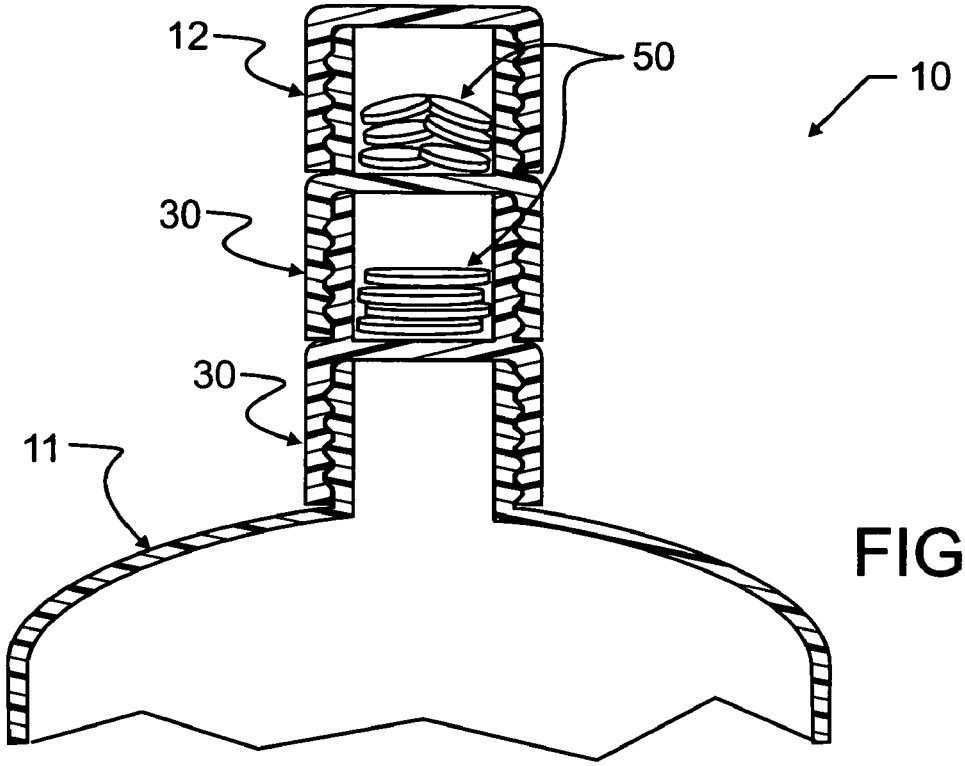
FIG. 3 illustrates the first preferred combination dispenser of FIG. 1 constructed in accord with the teachings of the invention from a sectioned view that has been sectioned along a vertical plane, and further including two preferred adjunct caps therein.

Manifested in the preferred embodiment, the present invention provides an infinitely stacking receptacle cap for pills and other articles which cooperates with existing bottles and bottle caps. In a most preferred combination dispenser 10 embodying the features of the invention as illustrated in FIGS. 1–3, a receptacle cap 30 is configured to contain pills and other articles, generally referred to herein as medicaments 50 irrespective of their actual chemical content and application, within an enclosed space isolated from container 11. Container 11 will, in the most preferred embodiment, be a liquid receptacle that may be used to transport water or other beverage. Container 11 may be a standard container such as is used in the retail trade for carbonated beverages and the like, or may be a custom container dictated by a particular need or application. As is well understood, container 11 will include a cover 12 which in this embodiment is a typical threaded cap suitable for forming a liquid-tight seal with container 11. Interspersed between cover 12 and container 11 is a preferred embodiment receptacle cap 30, within which medicaments 50 may be stored.

Medicaments 50 will, in the most preferred combination dispensers, comprise aspirin, nitroglycerin, or other similar emergency medications. This most preferred combination dispenser 10 offers the greatest advantage with this particular combination of beverage container 11 and emergency medication such as aspirin or the like, since aspirin is known to reduce the severity of heart damage when an aspirin is consumed with the onset of symptoms. As has been known, even though the aspirin is beneficial, there have been heretofore many occasions where a person was unable to successfully consume the pill, owing to the lack of an adequate beverage source. This situation is particularly vexing during physical exertion in various sports, where the athlete may be substantially removed from any accessible beverage. One such situation, which is exemplary but not limiting, is long distance running such as in a marathon or the like, where a runner will travel a great distance and only carry an absolute minimum of gear. In some distance events, there may not be nearby sources of beverages. Certainly in many instances during training this may be the case.

In nearly all of these events, the athlete or participant will have a small supply of beverage. When the beverage container such as container 11 is combined with the present receptacle cap 30, emergency medication may be transported without measurable displacement or inconvenience. In view of the imperative nature of taking the medication promptly, this ability to combine medication with beverage is most preferred. Nevertheless, the present invention is conceived with more than medications or prescriptions in mind, and receptacle cap 30 may be used to store any item within the general outline of receptacle 11 that may be desired and which will fit within the space provided. Most preferably, however, receptacle cap 30 will be designed to mate both with receptacle 11 and cover 12, and thereby require only one additional component for the proper use and operation thereof.

FIG. 2 illustrates receptacle cap 30 in much greater detail by enlarged sectional view. As may be discerned therefrom, receptacle cap 30 will most preferably be a single, unitary piece. This single piece may be manufactured using a variety of known techniques, none which are critical to the invention, though most artisans will recognize the commonly known benefits and advantages of injection and blow-molded plastics for low-cost high volume production, and for the ability to form relatively intricate features within the commonly used modern plastics. As visible in FIG. 2, receptacle cap 30 includes a lower closure body 31 and an upper receptacle cavity 34 which join at shoulder 35. Lower closure body 31 encompasses the male threading on the top of receptacle 11 and forms a tight seal by engaging with the top of receptacle 11, to maintain any liquid that may be held within receptacle 11 against leakage. While not illustrated, a gasket such as is known in the art of bottle caps may be provided either integral to receptacle cap 30 or separate therefrom at the interior of lower closure body 31 most nearly adjacent cover 12 to facilitate sealing. The flat surface provided therein facilitates the use of such a gasket.

An exterior male thread 33 is provided which engages securely with cover 12, and which most preferably similarly prevents the ingress or egress of liquids when cover 12 is engaged therewith. An additional gasket may additionally be provided adjacent to cap 12, though cap 12 will most frequently either be provided with one, or will alternatively be of composition not requiring such a gasket. A level divider wall 36 separates upper receptacle cavity 34 from any liquid within receptacle 11, essentially following the level of shoulder 35. The benefit of this level divider wall 36 is the ability to stack multiple receptacle caps 30 one upon another without interference or the risk of uncontrolled damage to the contents 50 held within receptacle caps 30. In other words, should a person need or desire two or more separate compartments or receptacle cavities 34, they may achieve the same simply by adding additional receptacle caps 30 onto each other. Since the male threads 33 match or are sufficiently similar to those of container 11 to be used with cap 12, this ability to stack is quite practicable in this preferred embodiment.

Figure 4:
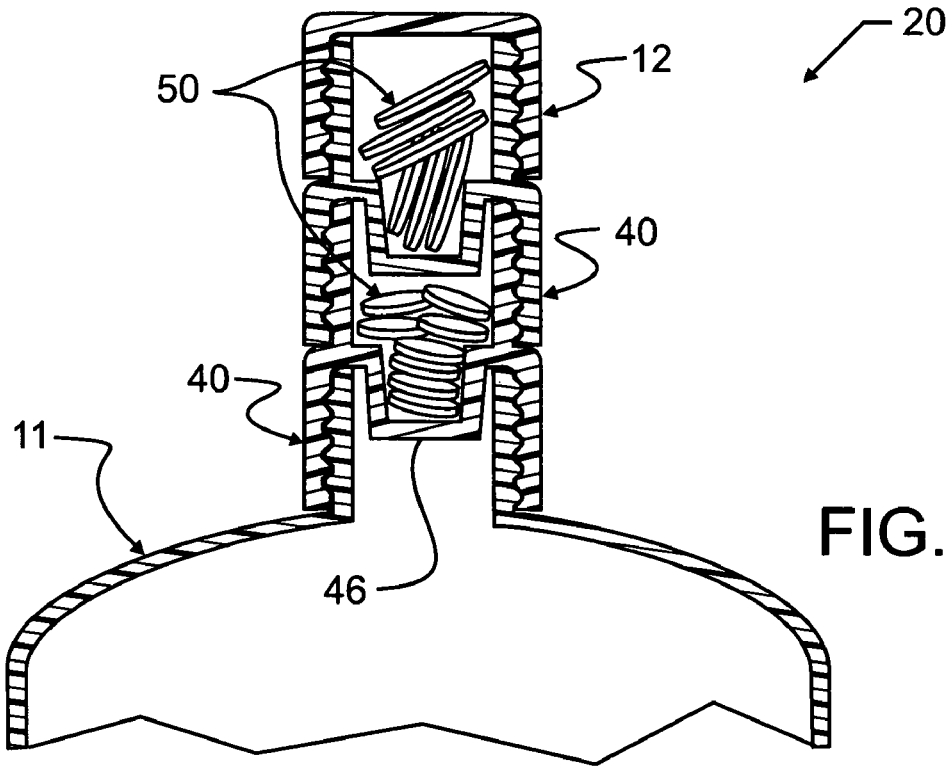
FIG. 4 illustrates a second preferred combination dispenser constructed in accord with the teachings of the invention from a sectional view sectioned along a vertical plane, illustrating a first alternative embodiment adjunct cap designed in accord with the teachings of the present invention.

A first alternative embodiment receptacle cap 40 is illustrated in FIG. 4, in combination with receptacle 11 and cap 12 to yield a combination dispenser 20. Receptacle cap 40 includes a deep well 46 which extends slightly into receptacle 11. This configuration is desirable where a single receptacle cap 40 is to be used with receptacle 11 and relatively larger or greater quantities of medicament 50 such as pills are to be carried therein. Well 46 may in this preferred embodiment extend from the uppermost portion of receptacle cap 40 adjacent cover 12 to well within receptacle 11, the exact extension not being critical to the understanding and working of the invention. Consequently, elongated objects may be stored without having to extend receptacle cap 40 substantially beyond where original cap 12 would have been located.

From these figures, several additional features and options become more apparent. First of all, receptacle caps designed in accord with the teachings of the present invention may be manufactured from a variety of materials, including metals, resins and plastics, ceramics or even combinations of the above. The specific material used may vary, though special benefits are attainable if the inventive receptacle cap is designed to accommodate environmental exposure at least as adequately as a typical receptacle 11, so that the novel receptacle cap may have ready application. Further, the ability to manufacture these receptacle caps in high volume and for low cost is most desirable, to enable widespread adoption in the marketplace. Polymers have been modified to have adequate resistance to environment, and are accompanied by low cost and ready manufacture to custom geometries. Common materials, though by no means so limited, include polyethylene terephthalate (PET), glycolated esters of PET (PETg), polyethylene, polypropylene, copolymers, and any of the myriad of other polymers as are already widely used and understood in the beverage industry today. Where items other than liquids are to be carried, an even wider variety of materials may be accommodated.

A variety of designs and ornamentations have been contemplated for receptacle caps 30 and 40, without departing from the spirit of the invention. These caps may include various figures or simulative shapes without altering the functional nature of the invention, and may include such resemblances as fire hydrants, fountains, wishing wells, tree stumps, various creature, fantasy or human figures, columns, cactus plants, company logos or mascots, and other thematic designs as may be desired and constructed. The materials used for a particular design may be chosen not only based upon the aforementioned factors such as weather and liquid resistance and weight, but may also factor in the particular design. For example, a receptacle cap resembling a fire hydrant that is formed from metal offers a particular amount of authenticity which would otherwise be unattainable with other materials such as plastics and ceramics.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. In combination:

a fluid receptacle having a coupling and an opening from an exterior of said fluid receptacle to an interior of said fluid receptacle, said opening permitting fluid to pass between said fluid receptacle interior and exterior;

a cover having a coupling co-operative with said fluid receptacle coupling, said cover preventing fluid from passing between said fluid receptacle interior and exterior when said cover coupling is coupled to said fluid receptacle coupling in a closing coupled relation and further removable entirely from said fluid receptacle coupling to open said receptacle opening; and a special receptacle cap removably holding a first composition adjacent said fluid receptacle and separating said fluid receptacle coupling from said cover coupling, said special receptacle cap comprising:

a divider wall;

a first coupling affixed to said divider wall and co-operative with said fluid receptacle coupling, said divider wall cooperative with said fluid receptacle to prevent fluid from passing between said fluid receptacle interior and exterior when said special receptacle cap first coupling is coupled to said fluid receptacle coupling in a closing coupled relation, said first coupling further removable entirely from said fluid receptacle coupling to separate said divider wall from said fluid receptacle and thereby open said receptacle opening;

a second coupling affixed to said divider wall engaging with said cover coupling in a closing coupled relation to form an enclosed chamber isolated from said receptacle and at least partially releasing to open said enclosed chamber.

2. The combination receptacle, cover and special receptacle cap of claim 1 wherein said special receptacle cap further comprises a first receptacle cap and a second receptacle cap, said first and second receptacle caps engaged to form a second cavity isolated from said first cavity and said receptacle.

3. The combination receptacle, cover and special receptacle cap of claim 1 wherein said fluid receptacle coupling further comprises a neck having said fluid receptacle opening passing therethrough.

4. The combination receptacle, cover and special receptacle cap of claim 3 wherein said fluid receptacle coupling further comprises external threads about said neck.

5. The combination receptacle, cover and special receptacle cap of claim 4 wherein said special receptacle cap first coupling further comprises external threads about a diameter corresponding to said neck.

6. The combination receptacle, cover and special receptacle cap of claim 3 wherein said cover comprises a cavity with an opening into said cavity.

7. The combination receptacle, cover and special receptacle cap of claim 6 wherein said cover coupling further comprises internal threads within said cavity.

8. The combination receptacle, cover and special receptacle cap of claim 6 wherein said special receptacle cap first coupling comprises a cavity with an opening into said cavity.

9. The combination receptacle, cover and special receptacle cap of claim 8 wherein said special receptacle cap first coupling further comprises internal threads within said cavity.

10. The combination receptacle, cover and special receptacle cap of claim 1 wherein said first composition is a solid edible composition.

11. The combination receptacle, cover and special receptacle cap of claim 10 wherein said first composition further comprises aspirin.

12. The combination receptacle, cover and special receptacle cap of claim 1 wherein said divider wall is generally planar, and second coupling is affixed to said divider wall on a surface of said divider wall opposite a surface where said first coupling is affixed.

13. A combination bottle, cap, and sectional container, said bottle having:

a liquid impervious body with a height and horizontal cross-sectional area;

a neck having a horizontal cross-sectional area less than said horizontal cross-sectional area of said liquid impervious body, said neck coupled to said body and having an opening from a first open end to a second body end and opening into said liquid impervious body adjacent said second body end and further having external threads;

said sectional container having:

a divider wall;

an internally threaded cavity adjacent to and extending from said divider wall in a first direction and encompassing and engaging with said external threads and extending between said first open end of said bottle neck and said second body end of said bottle neck; and an externally threaded neck adjacent to and extending from said divider wall in a direction generally opposed to said first direction enclosed at a first end by said divider wall and open at a second end and further having external threads, said externally threaded neck extending a distance between said first end and said second end approximately equal to said distance between said first open end of said bottle neck and said second body end of said bottle neck;

said cap having an internally threaded cavity encompassing and engaging with said external threads of said sectional container neck and extending between said first open end of said bottle neck and said second body end of said bottle neck.

14. The combination bottle, cap, and sectional container of claim 13 wherein said sectional container further comprises:

a second divider wall;

a second internally threaded cavity adjacent to and extending from said second divider wall in a first direction and encompassing and engaging with said external threads of said sectional container externally threaded neck and extending between said first open end of said bottle neck and said second body end of said bottle neck; and a second externally threaded neck adjacent to and extending from said second divider wall in a direction generally opposed to said first direction enclosed at a first end by said second divider wall and open at a second end and further having external threads, said externally threaded neck extending a distance between said first end and said second end of said second externally threaded neck approximately equal to said distance between said first open end of said bottle neck and said second body end of said bottle neck.

15. In combination:

a beverage container having a coupling and an opening from an exterior of said beverage container to an interior of said beverage container, said opening permitting fluid to pass between said beverage container interior and exterior;

a cover having a coupling co-operative with said beverage container coupling, said cover preventing fluid from passing between said beverage container interior and exterior when said cover coupling is coupled to said beverage container coupling in a closing coupled relation and further removable entirely from said beverage container coupling to open said beverage container opening; and a special receptacle cap removably holding a first composition adjacent said beverage container and separating said beverage container coupling from said cover coupling, said special receptacle cap comprising:

a divider wall;

a first coupling affixed to said divider wall and co-operative with said beverage container coupling, said divider wall cooperative with said beverage container to prevent fluid from passing between said beverage container interior and exterior when said special receptacle cap first coupling is coupled to said beverage container coupling in a closing coupled relation, said first coupling further removable entirely from said beverage container coupling to separate said divider wall from said beverage container and thereby open said beverage container opening;

a second coupling affixed to said divider wall engaging with said cover coupling in a closing coupled relation to form an enclosed chamber isolated from said beverage container and at least partially releasing to open said enclosed chamber.

16. The combination beverage container, cover and special receptacle cap of claim 15 wherein said special receptacle cap further comprises a first receptacle cap and a second receptacle cap, said first and second receptacle caps engaged to form a second cavity isolated from said first cavity and said beverage container.

17. The combination beverage container, cover and special receptacle cap of claim 15 wherein said first composition is a solid edible composition.

18. The combination beverage container, cover and special receptacle cap of claim 17 wherein said first composition further comprises aspirin.

* * * * *